US005226198A

United States Patent [19]

Martin

[11] Patent Number: 5,226,198

[45] Date of Patent: Jul. 13, 1993

[54] PAINT ROLLER EXTENSION POLE WITH COUPLING

[75] Inventor: Berj A. Martin, Boring, Oreg.

[73] Assignee: Purdy Corporation, Portland, Oreg.

[21] Appl. No.: 906,542

[22] Filed: Jun. 30, 1992

[51] Int. Cl.[5] ..... B44D 3/28

[52] U.S. Cl. ..... 15/230.11; 15/176.3; 15/145; 403/343; 273/80 R; 7/167; 81/489; 135/76; 16/114 R

[58] Field of Search ..... 15/230.11, 176.3, 145; D8/DIG. 7; 403/287, 292, 296, 301, 342, 343; 273/80 R; 16/114 R, 114 A, DIG. 41; 7/167; 81/489; 135/76

[56] References Cited

U.S. PATENT DOCUMENTS

| | | | |
|---|---|---|---|
| 2,834,625 | 5/1958 | Stanley et al. | 287/125 |
| 3,380,097 | 4/1968 | Pharris | 15/230.11 |
| 3,682,516 | 8/1972 | Savage | 15/145 |
| 3,984,192 | 10/1976 | Wanner et al. | 408/226 |
| 4,003,669 | 1/1977 | Fenske et al. | 403/288 |
| 4,118,135 | 10/1978 | Cooper | 403/361 |
| 4,154,545 | 5/1979 | Pinto et al. | 403/104 |
| 4,362,419 | 12/1982 | Duncan | 403/343 |
| 4,461,057 | 7/1984 | Unger | 16/DIG. 41 |
| 4,524,484 | 6/1985 | Graham | 16/DIG. 41 |
| 4,634,613 | 1/1987 | Potter | 403/299 |
| 4,637,458 | 1/1987 | Hernandez | 403/343 |
| 4,642,837 | 2/1987 | Nichols | 15/145 |
| 4,663,796 | 5/1987 | Helling et al. | 15/145 |
| 4,684,283 | 8/1987 | Lewis | 403/299 |
| 4,700,420 | 10/1987 | Belanger | 7/167 |
| 4,848,956 | 7/1989 | Pettman | 403/349 |

*Primary Examiner*—Harvey C. Hornsby
*Assistant Examiner*—Gary K. Graham
*Attorney, Agent, or Firm*—Klarquist, Sparkman, Campbell, Leigh & Whinston

[57] ABSTRACT

An extension pole for a paint roller or the like. The pole has a threaded neck for engaging interior threads of a handle. An O-ring or neck engages an end of the handle to resist rotation of the pole relative to the hollow handle.

3 Claims, 1 Drawing Sheet

PAINT ROLLER EXTENSION POLE WITH COUPLING

TECHNICAL FIELD

The present invention relates to a combination of a paint roller and an extension pole therefor that is designed to prevent the paint roller from coming loose from the pole.

BACKGROUND INFORMATION

One of the problems of paint rolling ceilings and other relatively inaccessible areas such as upper portions of high sidewalls is the difficulty of reaching the same. A ladder is often time consuming to move about and provides only a limited work area in the range of the ladder.

It is therefore desirable to provide an extension pole for a paint roller, so that normally inaccessible areas can be painted without the use of a ladder. U.S. Pat. Nos. 3,380,097, Pharris; 4,461,057, Unger; and 4,524,484, Graham pertain to such poles.

Conventional paint rollers have internally threaded handles so as to be capable of mounting on a cooperatively threaded extension pole. One of the problems with current configurations is that the roller assembly tends to come loose on the extension pole, which is obviously undesirable.

SUMMARY OF THE INVENTION

It is an object of the present invention to provide a combination of a paint roller assembly and an roller extension pole therefor that is designed to prevent the roller assembly from coming loose from the pole during painting operations.

This invention achieves this objective by providing an extension pole having an externally threaded neck portion adapted to be threaded into the roller assembly handle, the pole having provisions for retaining an O-ring that is compressed by the handle when it is mounted on the pole so that unthreading of the handle is resisted.

DETAILED DESCRIPTION OF A PREFERRED EMBODIMENT

Figures 1, 2, 3, 4, 5:
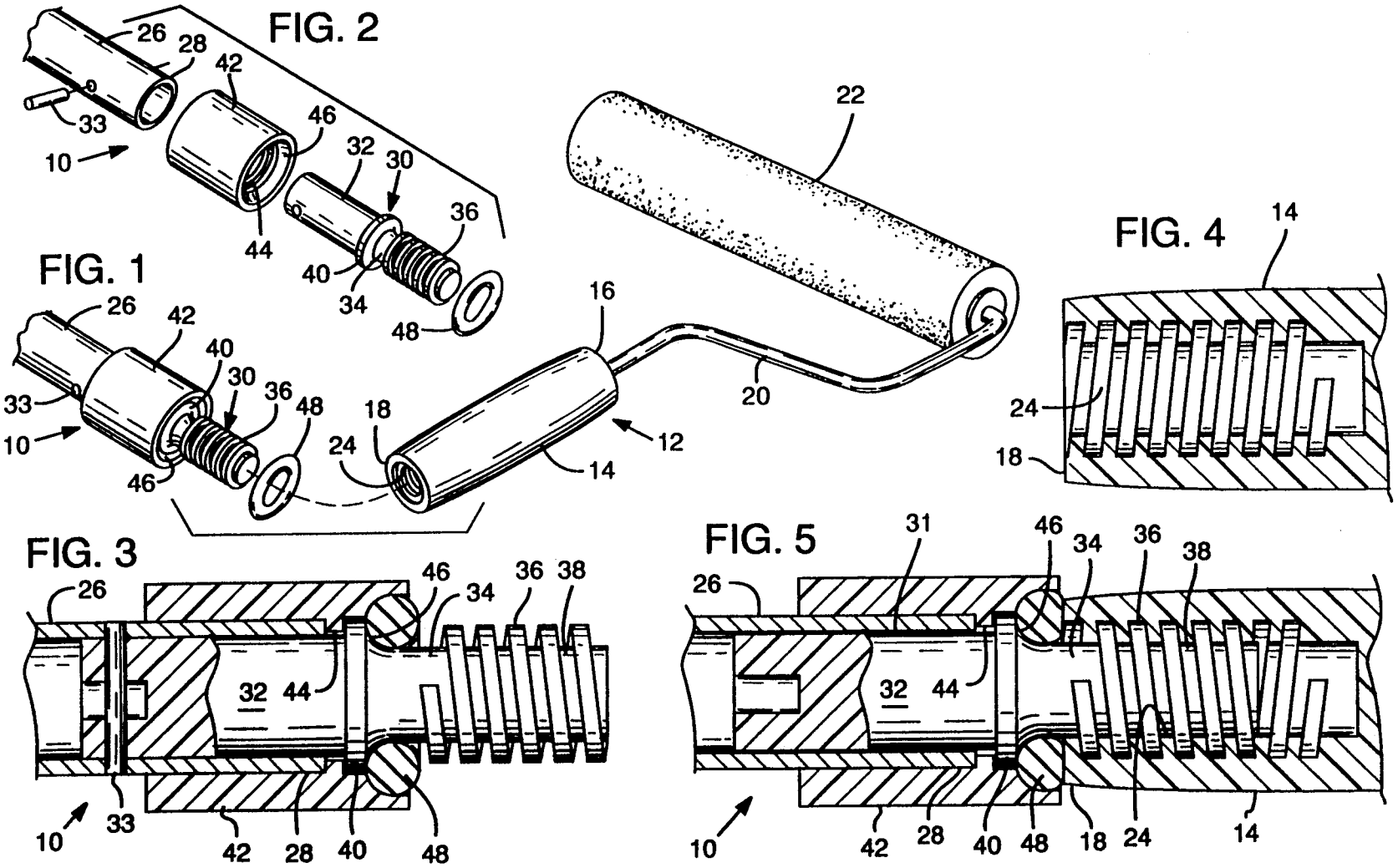
FIG. 1 is an exploded perspective view of the roller extension pole of the present invention and a conventional roller assembly.
FIG. 2 is an exploded view of a portion of the extension pole.
FIG. 3 is an enlarged longitudinal cross-sectional view of the connecting portion of the extension pole.
FIG. 4 is an enlarged longitudinal cross-sectional view of the internally threaded handle of a paint roller assembly.
FIG. 5 is an enlarged cross-sectional view of the extension pole threadedly attached in the threaded handle of the roller assembly.

Referring to the drawings, FIG. 1 illustrates a portion of an extension pole 10 constructed in accordance with the present invention for cooperative engagement with a conventional paint roller assembly 12. The paint roller assembly 12 comprises an elongated hollow body or handle 14 having an upper end 16 and a lower end 18. The upper end of the handle 14 is secured to a metal rod 20 which rotatably supports a roller 22. The handle or body 14 has an internally threaded bore 24 defined at the lower end 18 as shown in FIGS. 1 and 4.

Referring to FIGS. 1-5, the extension pole 10 comprises an elongated tubular member 26 having a top most portion 28. In the preferred embodiment, the tubular member 26 is made of a light weight material such as plastic or aluminum. The tubular member 26 can also be solid as long as the top-most portion 28 is hollow.

Mounted to the top-most portion 28 is a coupling element 30 including an elongated cylindrical base portion 32 disposed inside the top-most portion 28, as best seen in FIG. 3. Fastening means, such as glue at 31 or a rivet 33 is provided to fix the base portion 32 to the tubular member 26.

The element 30 has a cylindrical neck portion 34 of a lesser diameter than the base portion 32 protruding from the top-most portion 28. The neck portion 34 has external threads 36 formed on its external surface 38 for cooperatively engaging in the threaded bore 24 of the handle 14. The external threads 36 are of a standard type such as ACME No. 5 to fit most roller assemblies. The neck portion 34 also has an outwardly protruding circumferential shoulder 40 positioned between the threads 36 and the top-most portion 28 of the tubular member 26.

A retaining sleeve 42 surrounds the top-most portion 28 and the shoulder 40. The sleeve 42 has an internal collar 44 abutting the top-most portion 28 of the tubular member 26 so that the collar 44 is captured between the shoulder 40 and the top-most portion 28. The sleeve 42 is formed with a quarter-circle recess immediately above the shoulder 40 and the neck portion is provided with an opposing arcuate surface so that together they define an annular seat 46 of semicircular cross section.

A resilient O-ring member 48 is disposed around the neck portion 34 and seated against the seat 46 for exerting a force against the handle 14 when the same is threaded onto the neck portion 34 so that relative rotation between the handle 14 and neck portion 34 is resisted. An undeformed ring member is shown in FIG. 3 and a deformed ring member is shown in FIG. 5. The deformation of the ring member 48 causes an axial force to be exerted between the external threads 36 of the extension pole and the internal threads 24 of the handle 14 so that rotational movement between them is resisted to resist loosening of the roller assembly 12 from the pole during operation. The pole 10 can be detached easily from the roller assembly 12 by rotating the pole 10 to unthread it from the handle 14.

In an alternative embodiment, the ring member 48 and seat 46 may be of rectangular cross section.

Having illustrated and described a preferred embodiment, it should be apparent to those persons skilled in the art that the illustrated embodiment may be modified in arrangement and detail. I claim as my invention, not only the illustrated embodiment, but all such modifications, variations and equivalents thereof as come within the true spirit and scope of the following claims.

I claim:

1. In combination, a paint roller assembly and extension pole therefor;

said paint roller assembly comprising:

an elongated hollow body having a lower end and an upper end;

a roller attached to said upper end;

said hollow body at said lower end having an internally threaded bore;

said extension pole comprising:

an elongated tubular member having a top-most portion adjacent said lower end of said hollow body;

a coupling element comprising a cylindrical base portion partially disposed inside the top-most portion of said tubular member, said element having a cylindrical neck portion of lesser diameter than said base portion protruding from said top-most portion, said neck portion having external threads formed on its external surface for cooperatively engaging in said threaded bore of said hollow body;

means operatively arranged between said base portion and said tubular member to fix said base portion to said tubular member;

said neck portion having an outwardly protruding circumferential shoulder positioned between said threads and said top-most portion of said tubular member;

a retaining sleeve surrounding said tubular member top-most portion, said shoulder, and a lower part of said neck portion, said sleeve being arcuately recessed immediately above said shoulder and said neck portion being provided with an opposing arcuate recess whereby said sleeve and said neck portion together define an upwardly facing seat;

said sleeve having an internal collar abutting said top-most portion of said tubular member; and a resilient ring member disposed around said neck portion and seated against said seat for exerting a force against said hollow body when the same is threaded onto said neck portion so that relative rotation between said hollow body and neck portion is resisted.

2. An extension pole for a paint roller or the like having an internally threaded handle, said extension pole comprising:

an elongated tubular member having a top-most portion;

a coupling element comprising a cylindrical base portion partially disposed inside the top-most portion of said tubular member, said element having a cylindrical neck portion of lesser diameter than said base portion protruding from said top-most portion, said neck portion having external threads formed on its external surface for cooperatively engaging in said threaded handle;

means operatively arranged between said base portion and said tubular member to fix said base portion to said tubular member;

said neck portion having an outwardly protruding circumferential shoulder positioned between said threads and said top-most portion of said tubular member;

a retaining sleeve surrounding said tubular member top-most portion, said shoulder, and a lower part of said neck portion, and being operatively connected to said tubular member to retain said sleeve on said tubular member, said sleeve being arcuately recessed immediately above said shoulder and said neck portion being provided with an opposings arcuate recess, whereby said sleeve and said neck portion together define an upwardly facing seat; and a resilient ring member disposed around said neck portion and seated against said seat for exerting a force against said handle when the same is threaded into said handle so that relative rotation between said handle and pole is resisted.

3. The roller extension pole of claim 2, wherein the resilient member is an O-ring.

* * * * *